US007055422B1

(12) United States Patent
Dindl et al.

(10) Patent No.: US 7,055,422 B1
(45) Date of Patent: Jun. 6, 2006

(54) REDUCED RECOIL ANTI-ARMOR GUN

(75) Inventors: Frank Dindl, Newton, NJ (US); Sergio Aponte, Paterson, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 44 days.

(21) Appl. No.: 10/711,263

(22) Filed: Sep. 7, 2004

Related U.S. Application Data

(63) Continuation-in-part of application No. 10/708,454, filed on Mar. 4, 2004, now abandoned.

(60) Provisional application No. 60/320,000, filed on Mar. 11, 2003.

(51) Int. Cl.
*F41A 3/54* (2006.01)
*F41A 3/78* (2006.01)

(52) U.S. Cl. ..... 89/194; 89/198; 42/1.06

(58) Field of Classification Search ..... 89/194, 89/198, 1.701, 1.702; 42/1.06
See application file for complete search history.

(56) References Cited

U.S. PATENT DOCUMENTS

| | | | | |
|---|---|---|---|---|
| 512,437 | A * | 1/1894 | Griffiths et al. | 89/144 |
| 3,111,883 | A * | 11/1963 | Brown et al. | 89/165 |
| 4,649,800 | A * | 3/1987 | Tessier | 89/194 |
| 4,677,897 | A * | 7/1987 | Barrett | 89/166 |
| 5,457,901 | A * | 10/1995 | Gernstein et al. | 42/1.06 |
| 5,491,917 | A * | 2/1996 | Dilhan et al. | 42/1.06 |
| 6,742,297 | B1 * | 6/2004 | Lakatos et al. | 42/1.06 |
| 2003/0056639 | A1 * | 3/2003 | Giza | 89/1.701 |
| 2003/0200692 | A1 * | 10/2003 | Lakatos et al. | 42/1.06 |

* cited by examiner

*Primary Examiner*—Michael J. Carone
*Assistant Examiner*—Bret Hayes
(74) *Attorney, Agent, or Firm*—Michael C. Sachs; John F. Moran

(57) ABSTRACT

An improved Barrett anti-armor gun that is modified to function from the open bolt with advanced primer ignition, wherein the forward momentum of the recoiling masses at the moment of firing offset a significant portion of the recoil impulse from firing. The modification reduces the recoil energy absorbed by the shooter.

9 Claims, 5 Drawing Sheets

REDUCED RECOIL ANTI-ARMOR GUN

CROSS REFERENCE TO RELATED APPLICATIONS

The present application is a continuation-in-part of application serial number 10/708,454 filed Mar. 4, 2004 now abandoned which in turn claims priority under 35 USC 119(e) of provisional application 60/320,000 filed Mar. 11, 2003, the entire file wrapper contents of both which applications are hereby incorporated by reference as though fully set forth at length herein.

GOVERNMENT INTEREST STATEMENT

The invention described herein may be manufactured and used by, or for the Government of the United States for governmental purposes without the payment of any royalties thereon.

FIELD OF INVENTION

The present invention relates in general to the field of anti-armor rifles, and particularly to modifications to the Barrett Model 82A1 semi-automatic rifle and derivative family of weapons to reduce recoil. More specifically, this invention relates to a mechanism that counteracts a significant portion of the recoil energy in a rifle, and particularly that enables the rifle to function from an open bolt with advanced primer ignition.

BACKGROUND OF THE INVENTION

An early generation armor-penetrating 25 mm caliber class shoulder-fireable rifle is constructed from a longitudinal external housing, containing inside in slidable contact and coaxial basic components comprising a barrel, a bolt and a bolt carrier. Residing inside the bolt carrier are the bolt and the bolt bias springs that exert an axial urge on the bolt in a forward direction towards the barrel on the front side of the rifle. A rear anchored drive spring distal to the bolt carrier resides inside the longitudinal external housing and operates in axial contact with the bolt carrier.

Prior to firing, the bolt carrier has strips a cartridge from the magazine and chambered it in the barrel. The bolt and bolt carrier have both made axial contact distally with the barrel now stationary and biased forward in the battery position against a proximal hard limit stop on the proximal side of the rifle. When the cartridge is fired inside the rifle to launch a projectile, the static state of all slidable components in the rifle is disrupted, and the conservation of momentum results in a rearward oriented recoil momentum on the rifle that is equal and opposite to the momentum of the projectile and propellant traveling forward down the barrel towards the muzzle.

Axial barrel springs connect the barrel to the external housing, biasing the barrel towards the battery position at the front of the rifle, and giving it limited motion range towards the rear of the rifle. The barrel's rearward range is determined by a distal limit stop fixed to the external housing. Thus the rifle is at its maximum length when the barrel is at rest against the proximal hard stop prior to the firing of cartridge, and the rifle is at its minimum length when the barrel momentarily hits the distal hard limit stop and the barrel springs are maximally deformed by tension or compression. At this maximal barrel spring deformation, the barrel springs absorb their maximum in recoil energy by converting kinetic energy into potential energy.

The barrel's hitting of the distal hard limit stop separates it from the bolt, and bolt carrier distally connected to the drive spring. The bolt, bolt carrier and drive spring have been traveling rearward with the barrel as a unit in contact. The bolt, bolt carrier and drive spring continue their rearward travel, further compressing the drive spring, until a force balance is reached between the rear oriented recoil force from the moving recoil masses and the forward acting drive spring force.

This force balance point corresponds to the minimum length of the drive spring, which has absorbed its maximum in recoil energy by converting kinetic energy to potential energy through spring compression. The drive spring then converts its potential energy back to kinetic energy by extension from the minimum length, pushing the bolt and bolt carrier forward. In this forward travel the bolt carrier strips a new cartridge from the magazine and chambers it in the barrel, on its way to achieving contact between the bolt, bolt carrier and the distal end of the barrel and forming a firing or combustion chamber. This contact is accompanied by a substantial momentum transfer from the bolt and bolt carrier urged forward by the drive spring, imparting a forward momentum to the barrel.

Under normal operation of a semi-automatic rifle, target aiming for the next round takes place after this contact, thus precision aiming is not compromised. However this momentum transfer has not been recruited into any performance function or benefit. It is simply wasted. The drive spring remains in a compressed state through the entire operational sequence of cartridge loading, chambering, firing, recoil and barrel return to battery position.

The drive spring constant typically dominates the other spring constants in the rifle, as exemplified by the sizable rear compartment it resides, providing the drive spring with substantially larger cross-sectional area and length for a high spring constant and spring stiffness. The combined gravitational effect of the moving masses over the springs in the rifle do not present any malfunction nor significant operational parameter deviation from angle to angle such that the rifle functions properly over a wide range of angles of inclination meeting its performance specification and design goals.

The firing mechanism of early generation rifle comprises a firing pin without a bias spring residing axially inside the bolt with their lengths being rather similar, a pin-pivoting trigger with a sear notch, and a spring loaded pivotal sear with a sear notch capture around the middle that cooperates in a locked manner with the trigger's sear notch in the non-firing position. When the trigger is pulled for firing, the spring loaded sear is freed and slides, releasing the firing pin. The firing pin then plunges forward axially through the stationary bolt and bolt carrier, its tip impacting the cartridge primer and firing the projectile from the cartridge inside the rifle. The trigger and sear are located behind the magazine. After a new magazine is loaded into the rifle, a retracting handle attached to the bolt carrier enables the bolt carrier to be manually retracted back sufficiently to initiate loading a new cartridge for firing.

After the trigger is pulled and the firing pin rushes forward to fracture the primer, the charge is set off. The projectile is sent forward down the barrel, and the recoil sends the barrel, spent shell, firing pin, bolt and bolt carrier rearward. Prior to the firing, the longitudinal firing chamber is established by the distal drive spring force acting on the bolt carrier containing the bolt, and the frontal reaction force from the proximal hard limit stop acting on the barrel. As long as the firing chamber is closed it is non-essential to remain stationary relative to the rifle at the time of firing to achieve projectile range.

The early generation platform's basic structure and associated operational sequence described thus far form the basis upon which further modifications are made to meet changing performance and functions. Though relatively simple, this platform provides sufficient flexibility to accommodate a number of significant modifications without complete redesign of the basic structural platform, meeting more demanding performance requirements and functions, and has become the platform of choice to serve the military in the future.

In a modification to improve the locking capability and firing reliability of the firing mechanism, the pin-pivoting trigger comes in contact with a second pin, which is in contact with a normally parallel transfer bar having a spring loaded rear pivot mount. The transfer bar acts against a spring loaded sear mounted on the bolt carrier and is normal to the rifle's axis. The sear has a hook in cooperation with another hook at the distal end of the firing pin. An axially placed spring around the firing pin connects the firing pin to the bolt and provides a forward bias.

During firing operation the trigger is pulled, rotating the transfer bar through a mutually contacting pin, resulting in an upward motion of the transfer bar. This upward motion of the transfer bar pushes back the spring loaded sear, releasing its hook from the cooperating hook on the distal end of the firing pin. Once unlocked, the spring loaded firing pin follows the spring's forward bias to plunge its proximal tip into the chambered cartridge, fracturing the primer and firing the projectile. This modification reduces the uncertainty of the position of the firing pin at the time the trigger is pulled. The supporting mechanism provides the locking capability on the firing pin in a non-firing condition, further improving its positional stability under field shock and vibration, and the forward bias spring on the firing pin provides greater and more consistent impact force to achieve more reliable firing.

In a modification to implement reliable semi-automatic firing in the shoulder fireable, armor piercing rifle, the slidable bolt carrier and the firing assembly's stationary trigger and pivotal transfer bar are modified. A rearward spring biased pivotal locking lever is also added distally to the bolt carrier. The sear and firing pin are similar to previous spring loaded designs. The pin mounted pivotal trigger is added with a slender latch hook that essentially stands upright and rotates forward when the trigger is pulled. The rear mounted and spring loaded pivotal transfer bar is added with a proximal slender catch member to work with the new latch hook in the trigger. This slender catch member is inclined at a positive angle to the horizontal, with its distal end slanting down and cooperating with the latch hook from the trigger, its proximal end slanting up and cooperating with the bottom of a vertically oriented spring loaded sear for the firing pin. Both the trigger and transfer bar are fitted with lugs facing each other for upward rotation of the transfer bar. The bolt carrier on its bottom distal end is added with a pivotal cocking lever pointing downward at the trigger and potentially interfering with the pivotal transfer bar.

When the trigger is pulled to fire a cartridge, the top of the pivotal trigger rotates forward, inducing the top mounted latch hook to follow. With the slidable bolt and bolt carrier in a forward position chambering the cartridge for firing, the bolt carrier's rear mounted cocking lever is out of the way of the stationary pivotal transfer bar, allowing the transfer bar's translational bias spring to freely push it forward. In the transfer bar's forward position, the forward rotated latch hook of the trigger misses the catch member on the transfer bar, and stays beneath it. This allows the mutually facing lugs on the trigger and transfer bar to contact and to rotate the transfer bar upward. In turn the downward spring biased vertical sear is pushed upwards, releasing the spring loaded firing pin to plunge forward to fire the cartridge.

The recoil sequence has been studied for further improvement to achieve overall smoothness. As the barrel, bolt and bolt carrier are sent backwards during the recoil, the barrel's limited rearward travel is defined by a distal limit stop mounted to the longitudinal external housing. The harsh impact on this stop separates the barrel from the bolt and bolt carrier which continue their rearward travel.

When the cartridge is fired, the recoil sends the battery positioned barrel, bolt, bolt carrier and the self-unlocking rod rearward, with the moving members in contact with the barrel. The fired projectile typically leaves the muzzle of the rifle at about the first ½" rearward travel by the barrel, making its trajectory immune to any shock events during the rest of the recoil. As the bolt carrier approaches the trigger, its rear mounted, down pointing self-unlocking lever crosses the space immediately in front of the interference shoulder. After an incremental travel, the self-unlocking lever engages the interference shoulder and is rotated forward and upward, with its frontal catch slot presented towards the self-unlocking rod.

Prior to the self-unlocking lever reaching its maximum forward rotation, its catch slot starts engaging the self-unlocking rod, which is still being pushed rearward by the barrel. Further forward rotation of the self-unlocking lever from the interference shoulder starts to gently separate the bolt carrier from the barrel. Momentarily later the bolt also separates from the barrel before the barrel hits the distal barrel limit stop. The limit stop is made of resilient rubber to further soften the impact.

At the point of barrel to bolt carrier separation prior to hitting the barrel limit stop due to the working of the self-unlocking rod, momentum is transferred from the barrel to the bolt carrier, decreasing the rearward velocity of the barrel resulting in a gentler impact on the barrel limit stop, and increasing the velocity in the bolt carrier. Upon the forward return stroke urged by the drive spring, the process is reversed, and the bolt and bolt carrier again strip a new cartridge from the magazine, and chambers it in the barrel, while the bolt and bolt carrier re-establish contact with the barrel and remain stationary in the battery position prior to the next firing.

In addition to smoothing the recoil profile, substantial investigations have been made to reduce the magnitude of the recoil. In yet another improvement, a variety of weapons have been developed over the years that use advanced primer ignition and functioning the rifle from open bolt, i.e. utilizing the forward momentum of the recoiling mass, to offset a portion of the recoil impulse from firing. One example is the 40 mm MK19 Grenade Machine Gun.

An example for illustration are the Barrett weapons currently manufactured for sale in the United States and other countries that weigh approximately 28 pounds, and function from the closed bolt position. When an efficient anti-recoil muzzle brake is used, the .50 caliber Model 82A1/XM107 produces recoil energy of approximately 35 foot-pounds. Recoil energy increases to approximately 60 foot-pounds if the muzzle brake is replaced with a sound suppressor. The 25 mm XM109 variant of this weapon produces recoil energy of approximately 80 foot-pounds with an anti-recoil muzzle brake. Without a muzzle brake, that is, with a bare muzzle, recoil energy increases to approximately 90 foot-pounds for the 30-pound version of the XM109.

The United States military generally will not permit soldiers to operate shoulder fired weapons with recoil energy in excess of 60 foot-pounds. Prior concepts for reducing recoil of the weapon involved increasing the recoiling mass, reducing the muzzle velocity of the projectile, improving the anti-recoiling effectiveness of the muzzle brake, and combinations of the preceding. Some of these approaches change the weapon's performance. Increasing recoil mass to reduce recoil velocity and recoil energy may cause earlier fatigue in the operator. By reducing the muzzle velocity of the projectile, the effective range is reduced. Depending on the application this may not be an acceptable solution. Higher anti-recoiling effectiveness of the muzzle brake may require altering the propellant charge characteristics to increase gas mass and gas pressure at the muzzle, together with shortening barrel length to maintain same muzzle velocity. Changing the charge introduces a variation to current variety, increasing the hurdle.

Hence there is still an unmet need to improve a smaller caliber weapon of less than 40 mm with high performance such as the Barrett Model 82A1 to further reduce recoil impulse and recoil energy while maintaining its advantages of a semi-automatic rifle that is shoulder fireable, armor penetrating or anti-armor, high targeting precision, relatively light-weight and small footprint. The need for such a weapon has heretofore remained unsatisfied.

SUMMARY OF THE INVENTION

The present invention satisfies this need to further reduce recoil impulse and recoil energy. It comprises a means for modifying small caliber weapons of less than 40 mm, and in particular the 25 mm and 0.50 calibers, to function from the open bolt position, with advanced primer ignition, to counteract a significant portion of the recoil energy. The forward momentum of the bolt and bolt carrier in the forward return of the full recoil cycle previously dissipated on the hard limit stop holding the barrel in the battery position has now been harnessed to reduce recoil momentum and recoil energy.

Recoil energy budget has a number of contributions over a period of time, rather than just the substantially instantaneous contributors of primer ignition and firing the charge or ammunition. It is relevant to consider recoil energy as contributed by all the dynamic events that occur from the moment of pulling the trigger to all components coming to a stop again at their pre-trigger positions after recoil.

The effect of recoil on the weapon's operator is an integrated experience in the range of a second. As prior arts indicated, during recoil the bolt carrier typically travels rearward by about ½" when the projectile leaves the muzzle. When the muzzle brake is installed it contributes a significant reduction in recoil energy, yet the muzzle brake only starts to function around the time the projectile passes by the muzzle brake, bringing with it combustion gas mass and gas pressure. In the time scale of milliseconds, the muzzle brake's contribution to recoil reduction occurs a long time after the fast combustion process of the charge is complete.

Several moving masses under recoil are spring biased, and as of the moments of pulling the trigger and firing the charge their associated movements deform the springs, converting kinetic energy into potential energy and vice versa at different stages of the recoil, reducing the recoil energy transmitted to the operator. The distally located drive spring dominates the energy effects of all the springs in the weapon. This present invention seeks to achieve multiple advantages contributing to recoil energy reduction by modifying the drive spring, as detailed in the description.

The ammunition used in the 25 mm XM109 produces an impulse of approximately 13 pound-seconds. As functioned from the closed bolt position, with a muzzle brake, the corresponding recoil energy is on the order of 80 foot-pounds.

Modifying the XM109 to function from the open bolt position with advanced primer ignition will further reduce the recoil energy to less than 60 foot-pounds.

The present invention modifies the basic structure of the early generation rifle architecture. The rifle is constructed from an elongated external housing, within which are axially slidable components comprising a barrel, a bolt, a bolt carrier and a firing pin. A single limit stop for the barrel has a relatively soft, deformable circumferential elastomer barrel bushing on both its proximal and distal surfaces for stopping the barrel in its forward and rearward travel, The rifle further comprises a muzzle brake, a drive spring, a firing mechanism assembly and a magazine, a charging handle mounted on the bolt carrier, a hand grip attached to the external housing proximal to the trigger, a shoulder mount, a gun sight and a carry handle both mounted on the elongated external tubing.

The elongated external tubing is fitted with a muzzle brake that is mounted on the front end of the barrel, followed by internal, slidable components comprising a barrel, a bolt and bolt carrier distal to the barrel. A firing pin fitted with a forward bias spring is in sliding contact inside the bolt. The bolt in turn is in sliding contact inside the bolt carrier, and also urged forward by a bias spring. The front end of the bolt carrier is recessed from the front end of the bolt but both make contact with the barrel during bolt locking in the firing operation. A drive spring is located in the distal portion of the elongated external tubing, with the distal ends of the drive spring and the elongated external tubing firmly connected together and remain stationary during operation. The magazine is positioned in front of the trigger.

The firing mechanism assembly comprises a trigger, a bolt carrier sear with both a translational spring bias and a rotational spring bias, a spring providing such rotational bias to the bolt carrier sear, a firing pin sear with a downward spring bias, a spring loaded firing pin with forward bias residing inside the bolt, a bolt carrier mounted pivotal latch that travels over the bolt carrier sear, and a firing pin sear release cam proximal to the bolt carrier sear mounted on the inside surface of the base of the elongated external tubing.

One feature of the present invention is modification of the XM109 to function from the open bolt position which corresponds to a position prior to stripping and chambering a cartridge in the firing cycle. This is accomplished by adding a bolt carrier sear to the trigger mechanism, with an appropriate corresponding sear notch added to the bolt carrier.

Another feature of the present invention is modification of the XM109 platform to function with advanced primer ignition. This is accomplished by employing a firing pin sear trip cam which releases the firing pin after bolt locking is completed and while the bolt carrier continues moving forward, and completing a sealed firing chamber ready for combustion, and activating the relatively soft distal barrel bushing into compression and deformation.

Still another feature of the present invention is to achieve a 4.3 pound-second (approximate) forward momentum of the counter-recoiling components at the time of primer ignition. This is accomplished through increasing the drive spring stiffness to provide the required velocity and associated forward momentum of the counter-recoiling components at the moment of firing.

While the Barrett Model 82A1 semi-automatic rifle, derivative family, and other specific weapon models are referred herein, it should be clear that this reference is made for illustration purpose only, without intention to limit the present invention to this specific weapon being referenced.

BRIEF DESCRIPTION OF THE DRAWINGS

The features of the present invention and the manner of attaining them will become apparent, and the invention itself will be understood by reference to the accompanying drawings and following description. In these drawings, like numerals refer to the same or similar elements. The illustrations are shown only for visual clarity and the purpose of explanation and might not be in exact proportion.

DETAILED DESCRIPTION OF PREFERRED EMBODIMENTS

Figure 1A:
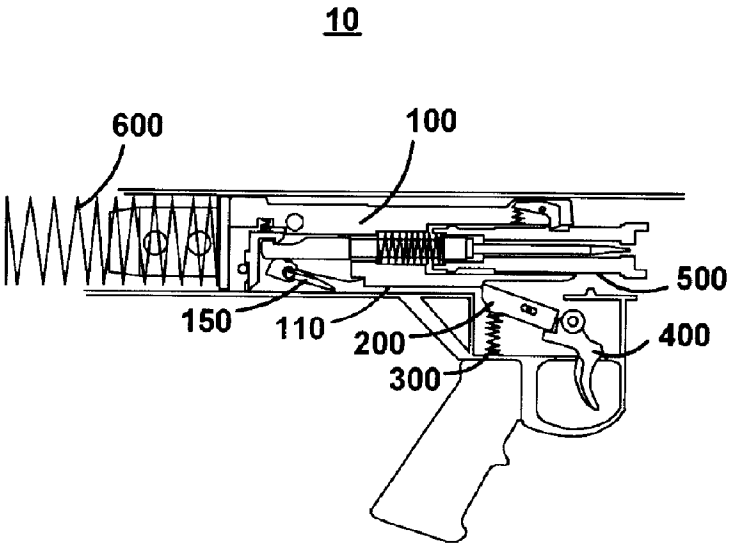
FIG. 1 is comprised of FIGS. 1A and 1B, and represents a side cross-sectional view of a weapon receiver showing basic modifications to a weapon, according to the present invention.
Figure 1B:
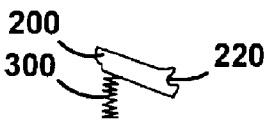

FIG. 1 illustrates a weapon 10 that comprises a down facing sear notch 110 in a bolt carrier 100, a pivotal bolt carrier sear 200 with a proximal slanted latch notch 220 with a rearward translational spring bias at the pivot, a bolt carrier sear spring 300 acting on the bolt carrier sear with a clockwise bias, a bolt carrier rear mounted firing pin cocking lever 150 with a clockwise rotational spring bias, a pivotal trigger 400, a firing pin sear trip cam 500, and a new drive spring 600 with a spring constant higher than conventional.

During operation, the bolt carrier 100 is pulled fully to the rear by the means of either a recoil or charging handle (not shown) currently employed in the weapon design, compressing the drive spring 600. As bolt carrier 100 is pulled to the rear, helical compression bolt carrier sear spring 300 forces bolt carrier sear 200 into an elevation capable of engaging bolt carrier sear notch 110 at the bottom of bolt carrier 100. When the bolt carrier 100 moves rearward, it does not engage in locking the pivotal bolt carrier sear 200.

When either the charging handle is released or during a recoil the drive spring 600 is compressed sufficiently to reverse direction to extend forward again, drive spring 600 pushes the bolt carrier 100 forward and it engages the pivotal bolt carrier sear 200 in sear notch 110, stopping the forward movement of bolt carrier 100, and holding it to the rear. This engagement occurs close to the distal reversal point resulting in a gentle hit on the bolt carrier sear 200. The translational rearward spring (not shown) bias at the pivot on the bolt carrier sear further assures reliable engagement with sear notch 110.

Figure 2:
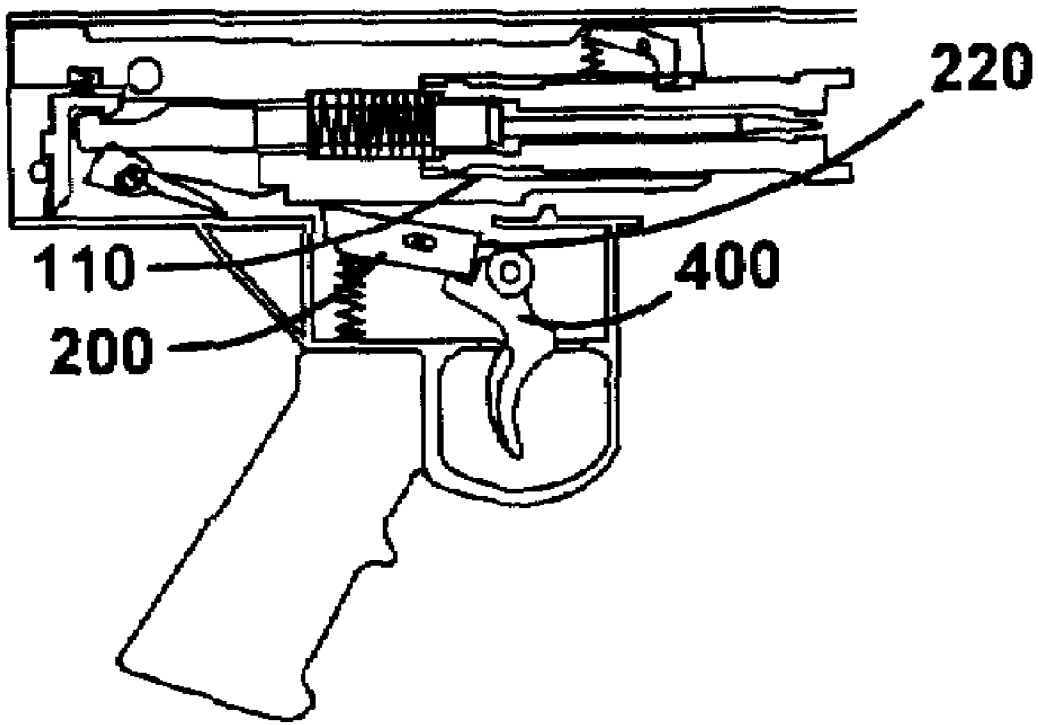
FIG. 2 is a side view cross-section sketch of the trigger mechanism that forms part of the basic modifications of FIG. 1.

FIG. 2 illustrates how the pivotal trigger 400 rotates clockwise, moving its shaped rear catch shoulder adjacent to the pivot into cooperation with the pivotal bolt carrier sear 200. Rotating the trigger 400 clockwise causes the bolt carrier sear to rotate counterclockwise, compresses the bolt carrier sear spring 300, and disengages the bolt carrier sear 200 from the bolt carrier sear notch 110, and lowers the rear upper corner of the pivotal bolt carrier sear to be at or below the interior plane of external tubing along which the lower tip of the bolt carrier pivotal latch 150 travels.

Figure 3:
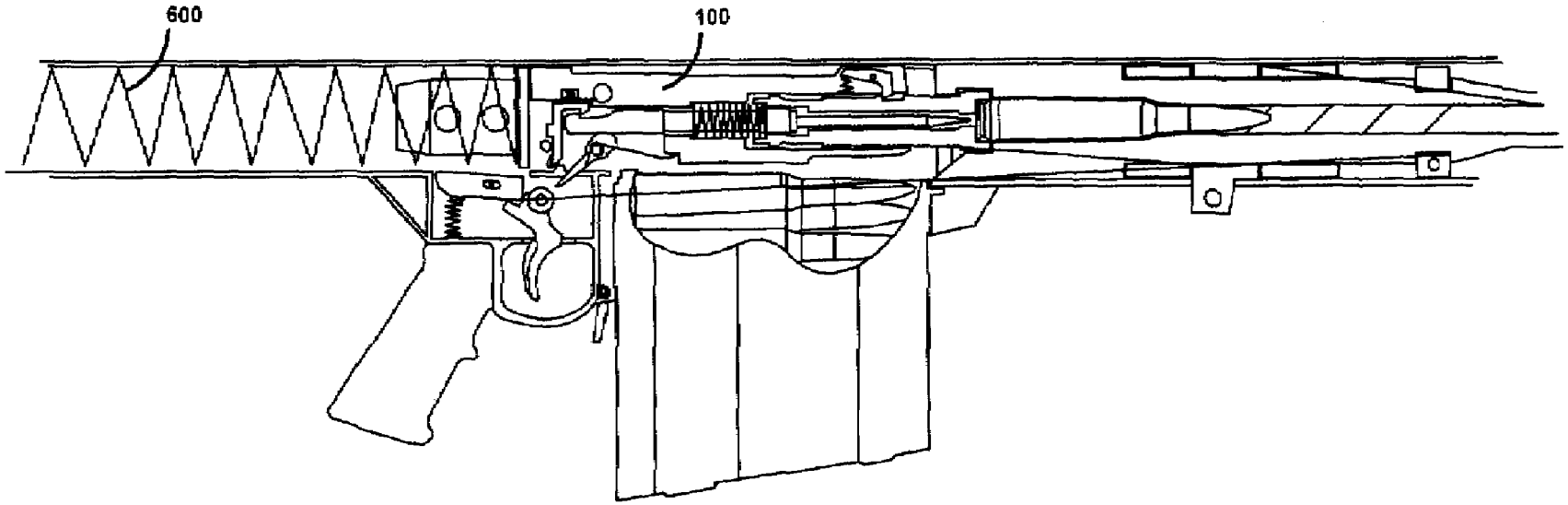
FIG. 3 is a side cross-sectional view of a weapon receiver showing a cartridge being stripped from the magazine.

The distal gap of the bolt carrier sear 200 for a pulled trigger is so small that the clockwise spring biased firing pin cocking lever tip 150 from the bolt carrier 100 simply passes over it without penetrating into the gap. This allows drive spring 600 to exert a spring force on the bolt carrier and resume moving the bolt carrier 100 forward with an acceleration and stripping and chambering a cartridge from the magazine (FIG. 3) into the barrel.

Figure 4:
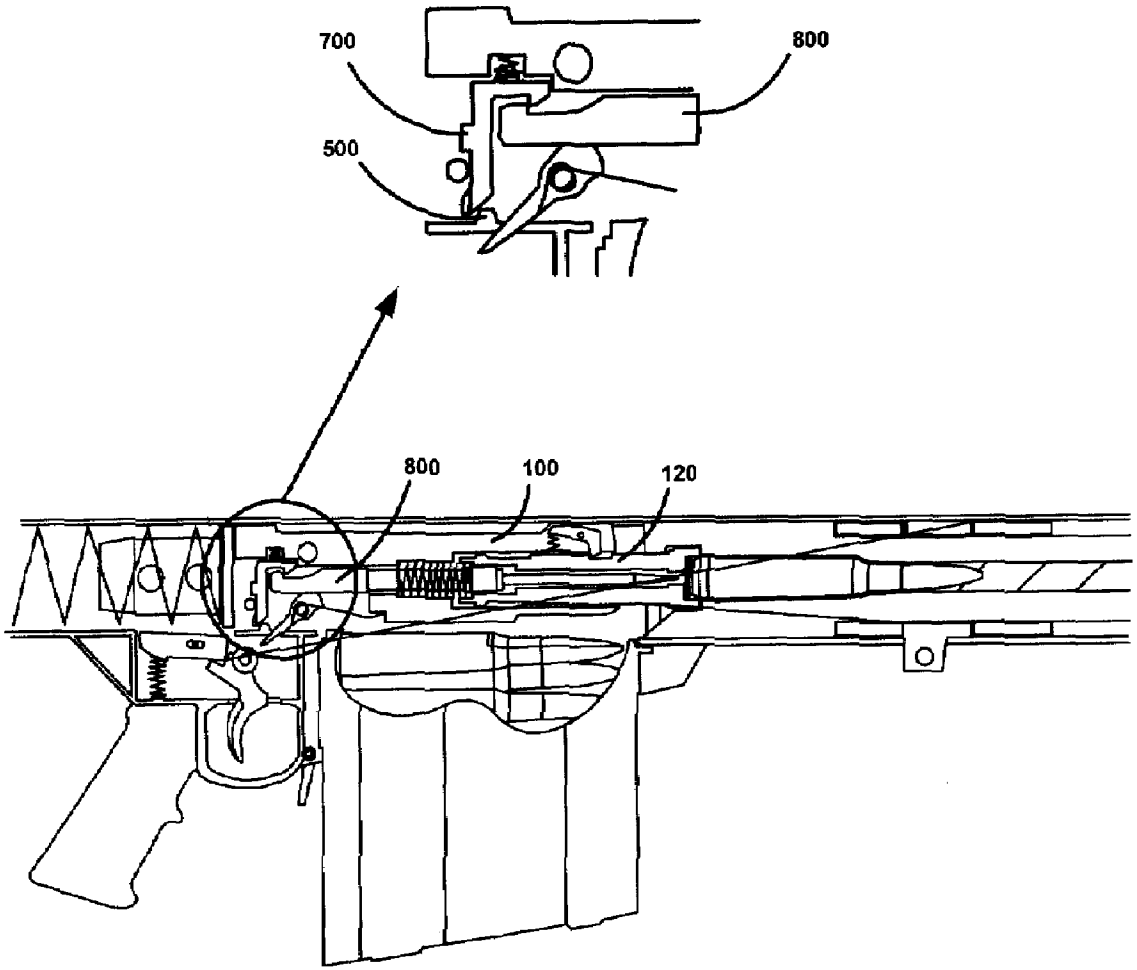
FIG. 4 illustrates the function of a firing pin sear trip cam in the weapon of FIG. 1.

As forward motion of bolt carrier 100 continues, bolt 120 is fully locked onto the barrel by the means currently employed in the weapon design, and the bolt and bolt carrier push the barrel forward in front of them. The firing pin sear 700 moves over firing pin sear trip cam 500. Firing pin sear trip cam 500, comprising a linear cam surface, raises the firing pin sear 700 mounted on the bolt carrier and spring biased downward, disengaging it from the spring actuated firing pin 800 (FIG. 4).

Figure 5:
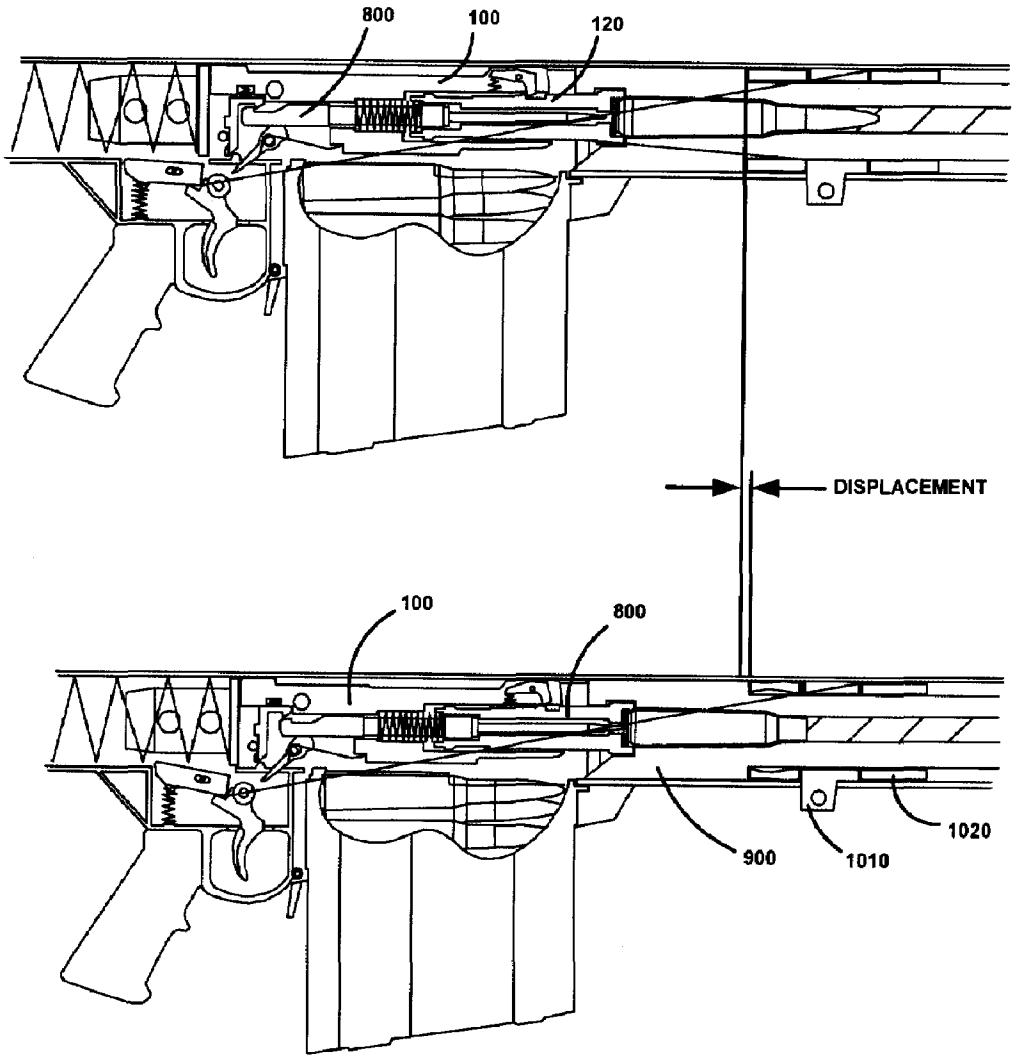
FIG. 5 is a side cross-sectional view of the weapon in a firing position.

Spring actuated firing pin 800 thus released, travels forward fracturing the primer and firing the cartridge (FIG. 5). These modifications are compatible with standard cartridges and standard firing mechanism, providing easy implementation.

Contact between bolt carrier 100, bolt 120 and barrel assembly 900 transfers the forward momentum of bolt carrier 100 and bolt 120 to forward biased barrel assembly 900 already at rest at a position set by the elastomer barrel bushing 1000 on the distal surface of barrel hard stop limiter 1010, causing compression of the elastomer resulting in forward displacement of barrel assembly 900. Barrel assembly displacement is attenuated by deflection of elastomer barrel bushing 1000 (FIG. 5), and the reversible deflection converts the moving masses' kinetic energy into potential energy, minus some losses due to dissipation. During recoil the rearward moving barrel assembly 900 encounters another elastomer barrel bushing 1020 on the proximal surface of barrel hard stop limiter 1000, causing elastic compression and deflection of the elastomer before reversing to forward travel under barrel spring bias. At the point of reversal, the barrel assembly 900 separates from the bolt 120 and bolt carrier 100.

The sealed firing chamber is established when the bolt locks the barrel and chambers the cartridge, and the bolt carrier locking onto the barrel creates a secondary enclosure against gas escape from firing chamber. Advanced primer ignition and combustion of the charge take place during the forward movement of the bolt, bolt carrier and barrel without compromising the integrity of the sealed firing chamber.

Forward momentum of the components at the moment of firing as described, offsets a significant portion of the recoil impulse from firing. For the 25 mm XM109, the required forward momentum of the counter-recoiling components at the time of primer ignition is approximately 4.3 pound-seconds to reduce the recoil energy of 80 foot-pounds when fired from current 25 mm XM109 rifle with a closed bolt and a muzzle brake to 60 foot-pounds, the acceptable recoil energy for shoulder firing operation by soldiers.

During recoil the stored potential energy in compressed elastomer barrel bushing 1000 is converted back to kinetic energy, minus some dissipation losses, adding to the recoil momentum. The second function of the stiffer spring is relevant here such that overall kinetic energy available for recoil is reduced, despite of this short duration and relatively weaker elastomer barrel bushing contribution.

FIGS. 1 and 5 also show the modified bolt carrier sear 200 with a latch notch 220. To increase the reliability of semi-automatic firing, and to prevent automatic firing while the trigger is still pulled after the previous firing, the bolt carrier sear 200 is modified with a forward facing slanted latch notch 220 on its front upper corner.

The latch notch 220 has a height such that when the trigger is released, and the bolt carrier sear is therefore maximally clockwise biased, it is out of the way for the bolt carrier mounted pivotal latch 150. In this condition, the bolt carrier sear 200 would engage the bolt carrier's sear notch 110 as designed. In fact, this is also the same orientation where a rearward traveling bolt carrier's pivotal latch with its clockwise spring bias reverses its tip orientation from rearward pointed to forward pointed by going over this angled bolt carrier sear.

It is to be understood that the specific embodiments of the invention that have been described are merely illustrative of certain applications of the principle of the present invention. Numerous modifications may be made to a reduced recoil anti-armor gun utilizing an advanced primer ignition and firing the weapon from open bolt described herein without departing from the spirit and scope of the present invention.

What is claimed is:

1. A weapon with reduced recoil, comprising:

an elongated external tubing;

a slidable barrel disposed within a proximal section of the tubing;

an elastic member that urges the barrel along a forward direction inside the tubing;

a slidable bolt carrier disposed within a tubing distal end, and comprising a pivotal lever and a bolt carrier sear notch;

a bolt disposed within the bolt carrier, distally related to the barrel;

a hard stop limiter disposed within the tubing with at least one hard stop limiter for absorbing at least in part, kinetic energy of moving masses within the tubing;

a stiffer drive spring for urging the bolt carrier along a forward direction; and a primer ignition and firing mechanism assembly.

2. The weapon according to claim 1, wherein a forward momentum of the moving masses offsets at least a portion of a recoil impulse from firing, thus reducing recoil energy absorbed by a user.

3. The weapon according to claim 1, wherein a forward momentum of the moving masses offsets at least a portion of a recoil impulse from firing, thus reducing recoil energy absorbed by a weapon mount.

4. The weapon according to claim 1, wherein the elastic member comprises a spring.

5. The weapon according to claim 4, wherein the spring has a spring constant that increases a forward momentum of the moving masses to offset a portion of a recoil impulse and recoil energy.

6. The weapon according to claim 1, wherein the bolt carrier comprises a spring that urges the bolt along a forward direction within the barrel.

7. The weapon according to claim 1, wherein the weapon functions from an open bolt position, and further comprises a sear notch in the bolt carrier, to enable anti-recoil masses to accelerate over a preset distance in order to gain velocity and momentum prior to firing.

8. The weapon according to claim 1, wherein the hard stop limiter comprises at least one relatively soft elastomer barrel bushing that is disposed within the elongated external tubing for absorbing at least in part, the kinetic energy of the moving masses within the tubing.

9. The weapon according to claim 1, further comprising a muzzle brake.

* * * * *